US009446323B2

(12) United States Patent
Goldreyer

(10) Patent No.: US 9,446,323 B2
(45) Date of Patent: Sep. 20, 2016

(54) FLEXIBLE WATER SLIDE

(71) Applicant: Super Sweet Air, Inc., Austin, TX (US)

(72) Inventor: Eric Goldreyer, Austin, TX (US)

(73) Assignee: Super Sweet Air, Inc., Austin, TX (US)

( * ) Notice: Subject to any disclaimer, the term of this patent is extended or adjusted under 35 U.S.C. 154(b) by 0 days.

(21) Appl. No.: 15/001,309

(22) Filed: Jan. 20, 2016

(65) Prior Publication Data

US 2016/0206964 A1 Jul. 21, 2016

Related U.S. Application Data

(60) Provisional application No. 62/105,384, filed on Jan. 20, 2015.

(51) Int. Cl.
*A63G 21/18* (2006.01)
*A63C 19/00* (2006.01)

(52) U.S. Cl.
CPC ..... *A63G 21/18* (2013.01)

(58) Field of Classification Search
CPC ..... A63G 21/00; A63G 21/18; A63C 19/00; A63C 19/10
USPC ..... 472/116, 117, 128, 134; 104/69, 70
See application file for complete search history.

(56) References Cited

U.S. PATENT DOCUMENTS

| | | | | |
|---|---|---|---|---|
| 6,062,983 | A * | 5/2000 | Butsook | A63G 21/18 4/488 |
| 6,312,341 | B1 * | 11/2001 | Healy | A63G 21/18 472/116 |
| 6,406,377 | B1 * | 6/2002 | Demko | A63G 21/18 472/116 |
| 7,309,302 | B1 * | 12/2007 | Phillips | A63C 19/10 472/116 |
| 2010/0137068 | A1 * | 6/2010 | Bogar | A63G 21/18 472/117 |
| 2010/0285893 | A1 * | 11/2010 | Leimone | A63G 21/18 472/117 |

* cited by examiner

*Primary Examiner* — Kien Nguyen
(74) *Attorney, Agent, or Firm* — DuBois, Bryant & Campbell LLP; William D. Wiese

(57) ABSTRACT

A recreational slide is presented having a lubricious top surface having an entry end and an exit end. Two side tubes are affixed laterally along each side of the slide to prevent water and users from sliding off the slide while in use. One or more water sprayers are located along the interconnection between the slide and one or both of the tubes to provide a continuous water supply to the surface of the slide. The exit end of the tube is configured with a connecting flap which removably attaches to the entry end of a tube of an adjoining slide to make a seamless transition between tubes. In addition, the water sprayers are configured so that the exit end of one water sprayer is interconnectable with the entry end of an adjoining water sprayer to make a seamless transition between water sprayers when interconnected.

9 Claims, 12 Drawing Sheets

FLEXIBLE WATER SLIDE

CROSS-REFERENCE TO RELATED APPLICATIONS

This application claims priority based upon prior U.S. Provisional Patent Application Ser. No. 62/105,384 filed Jan. 20, 2015 in the name of Eric Goldreyer, entitled "Flexible Water Slide," the disclosure of which is incorporated herein in its entirety by this reference.

BACKGROUND OF THE INVENTION

Elongated strips of plastic material placed on the ground and wetted with water to decrease friction have been used as rudimentary backyard slides for years. In some cases, the plastic was secured to the ground and in other cases it was left unsecured. A variety of wetting techniques were used for supplying a more or less constant layer of water onto the upper surface of the material. As time passed, safety concerns dictated that the material be affixed more securely to the ground and that methods be employed for delivering a constant layer of water to the surface of the material.

A number of products evolved as specialty water slides manufactured for pool and amusement park use. These products typically featured a long slide extending down a hill or otherwise having the start of the slide elevated, and typically required pools, water filled areas and a relatively large area to function.

However, even as the products developed, there were a number of issues associated with conventional designs that created safety issues and detracted from the enjoyment of the slides. For example, many of the backyard slides were small and, when place in the yard, were angled slightly such that users who dived onto the slide would slide off of the lateral edge of the slide, thereby abruptly stopping in such a way that could cause permanent spinal cord injury, or resulting in quadriplegia or paraplegia.

Moreover, although many product manufacturers provided wetting mechanisms as a feature of the slide, they footprint of the wetted area was uneven resulting in some areas with ponding or puddling water and other areas with no water at all. This discrepancy was magnified by the placement in a backyard having an uneven grassy surface. In these instances, when users dived onto the slide, they may have encountered a large splash when sliding through a puddle, but quickly realized that the thickness of the water acted to slow their progress across the slide, thereby detracting from the enjoyment. Moreover, a much more serious event occurred when the user encountered a dry spot on the slide causing the user's forward momentum to drive the body into the neck, thereby compressing the spinal cord, again potentially causing permanent spinal cord injury, quadriplegia or paraplegia.

There is a need, therefore, for a safe, entertaining water slide capable of keeping users on the longitudinal axis while sliding on the slide while assuring consistent, reliable distribution of water over the entire surface of the slide. In these respects, the water slide system according to the present invention substantially departs from the conventional concepts and designs of the prior art.

SUMMARY OF THE INVENTION

Embodiments of the present invention include an elongated recreational water slide that is used in a backyard or other open area. Various embodiments are designed to be interconnected and include an integrated water sprayer that keeps the sliding sheet wet, and therefore slippery, by the continuous application of water. The sliding sheet may be constructed with materials known in the art, including, by way of example, commercial grade, UV protected, PVC so that the slide will last for many uses.

In certain embodiments, two side tubes are affixed laterally along each side of the sliding sheet to prevent water and users from sliding off the slide while in use. One or more water sprayers may be located along the interconnection between the slide and one or both of the tubes to provide a continuous water supply to the surface of the sliding sheet. The exit end of the tube is configured with a connecting flap which removably attaches to the entry end of a tube of an adjoining slide to create a seamless transition between tubes. In addition, the water sprayers are configured so that exit end of one water sprayer is interconnectable with the entry end of an adjoining water sprayer to make a seamless transition between water sprayers when interconnected.

The foregoing has outlined rather broadly certain aspects of the present invention in order that the detailed description of the invention that follows may better be understood. Additional features and advantages of the invention will be described hereinafter which form the subject of the claims of the invention. It should be appreciated by those skilled in the art that the conception and specific embodiment disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention and the advantages thereof, reference is now made to the following description taken in conjunction with the accompanying drawings in which like reference numerals indicate like features and wherein.

DESCRIPTION OF THE PREFERRED EMBODIMENTS

The present invention is directed to improved methods and systems for constructing, among other things, a flexible water slide. The configuration and use of the presently preferred embodiments are discussed in detail below. It should be appreciated, however, that the present invention provides many applicable inventive concepts that can be embodied in a wide variety of contexts other than construction of a flexible water slide. Accordingly, the specific embodiments discussed are merely illustrative of specific ways to make and use the invention, and do not limit the scope of the invention. In addition, the following terms shall have the associated meaning when used herein:

Referring now to FIG. 1 through FIG. 5 which show an embodiment of the slide of the present invention having a lubricious sliding sheet 101. The sliding sheet 101 is oriented longitudinally with the slide entry 103 at one end of the slide and the slide exit 105 on the other end. The sliding sheet 101 may be constructed of 0.45 mm reinforced, coated, PVC or similar durable material. The top surface of sliding sheet 101 becomes slippery once water is applied to the surface. As discussed in more detail later, multiple slides may be interconnected to increase the length of the sliding surface and, in such cases, in may be desirable for slide entry 103 to include additional material, or a tongue 111, that facilitates such interconnection and provides a safe, smooth transition between the surfaces of the interconnected slides.

Figure 4:
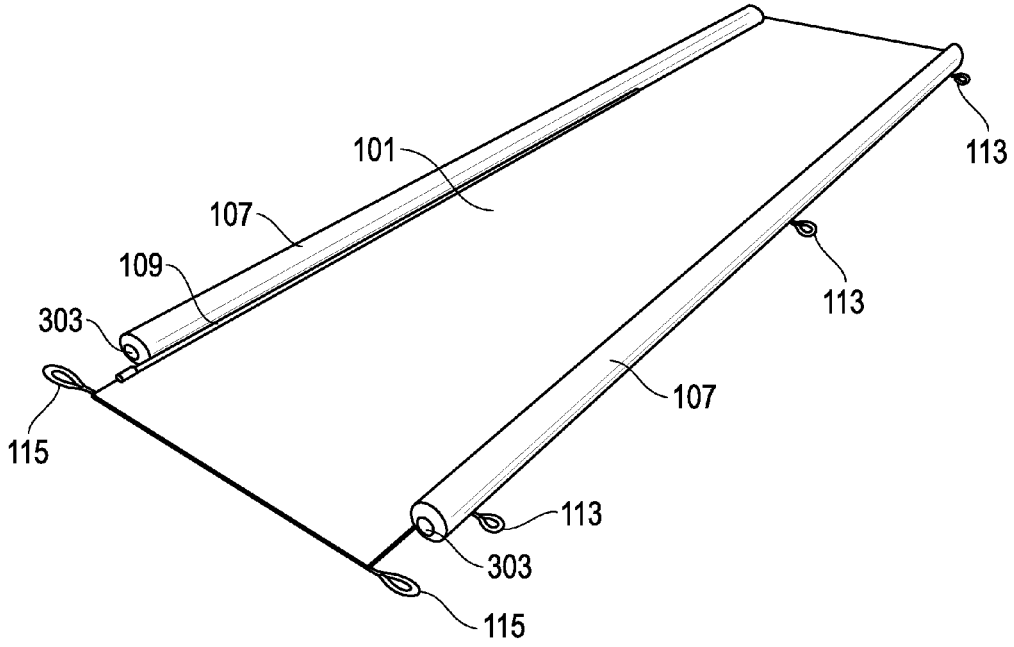
FIG. 4 is a right front isometric view of one embodiment of the flexible water slide of the present invention.

As shown in FIG. 4, a stake strap 115 may also be attached to the tongue 111 which is slightly longer than the straps on the tube 113 so that they all extend from the slide the same length allowing for optimum stake down of the slide. Instructional graphics may be printed on the slide to ensure riders know in which direction to use the slide.

Embodiments of the slide include inflatable tubes 107 along the left side and the right side of sliding sheet 101. The tubes 107 may be sewn to the sliding sheet 101 or otherwise attached either removably or permanently. In certain embodiments, these tubes 107 may be made from reinforced PVC or similar material. The tubes 107 are designed to keep water from exiting the lateral edges of the sliding sheet 101, thereby retaining more water on the sliding sheet 101. The tubes 107 also serve the function of keeping a user from sliding off the lateral edges of the sliding sheet 101 while in use, thereby improving safety and enhancing the user's enjoyment of the slide.

Figure 1:
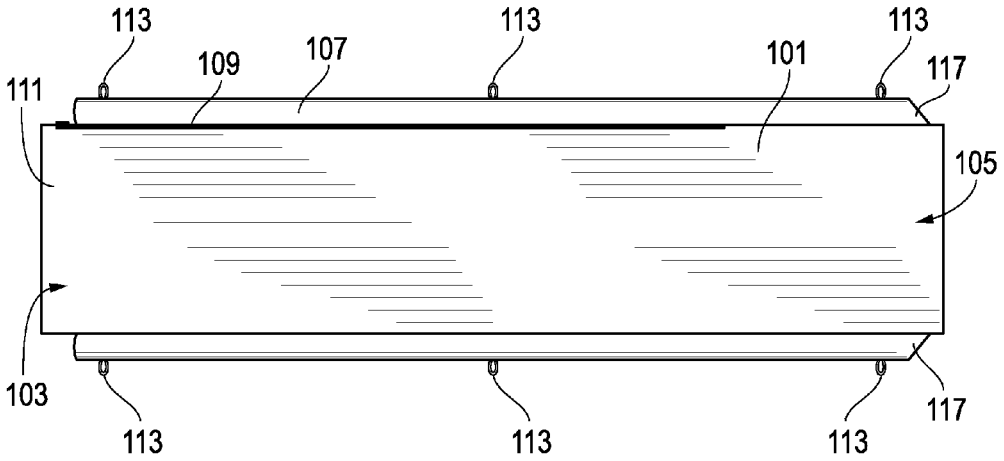
FIG. 1 is a top view of one embodiment of the flexible water slide of the present invention.
Figure 2:
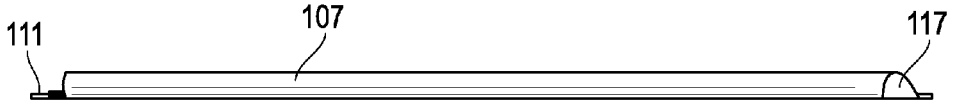
FIG. 2 is a side view of one embodiment of the flexible water slide of the present invention.
Figure 3:
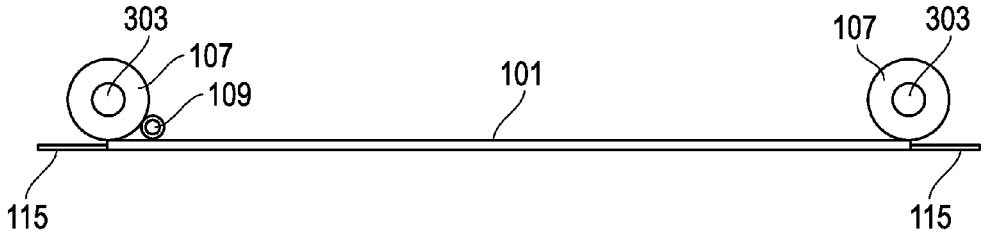
FIG. 3 is a front view of one embodiment of the flexible water slide of the present invention.
Figure 5:
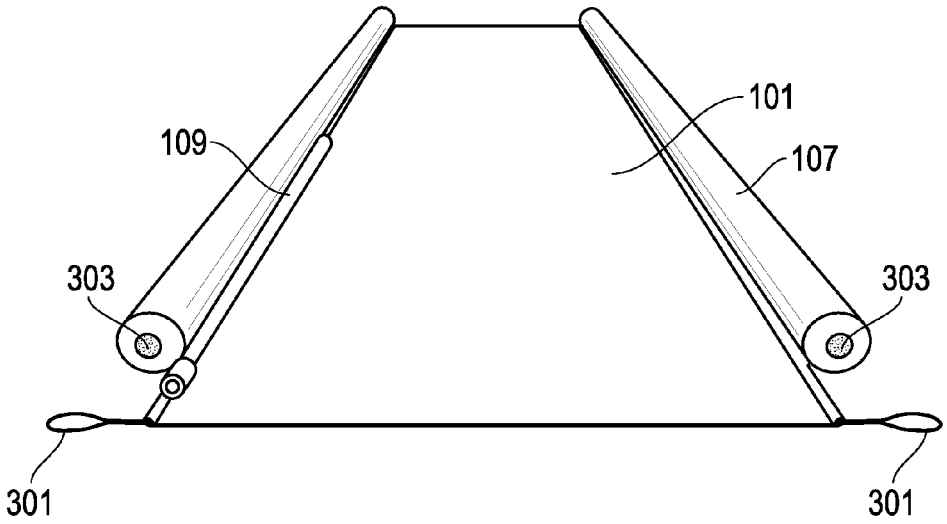
FIG. 5 is a center front isometric view of one embodiment of the flexible water slide of the present invention.

As can be seen in FIG. 3, FIG. 4 and FIG. 5, each tube 107 is affixed with a removable end cap 303 which may be dislodged or removed during inflation of the tubes 107 and then replaced to retain air in the tubes 107 after inflation. The end caps 303 may be, for example, hot air welded onto the end of each tube 107. Each tube 107 may also be configured with an inflation valve located in the end cap 303. The inflation valve can accommodate a manual pump or an electric pump for further inflation of the tubes 107. In certain embodiments, the tubes 107 are designed to hold 2 psi of air and are staked into the ground using straps 113 once they are inflated to help them hold a straight position.

Figure 6:
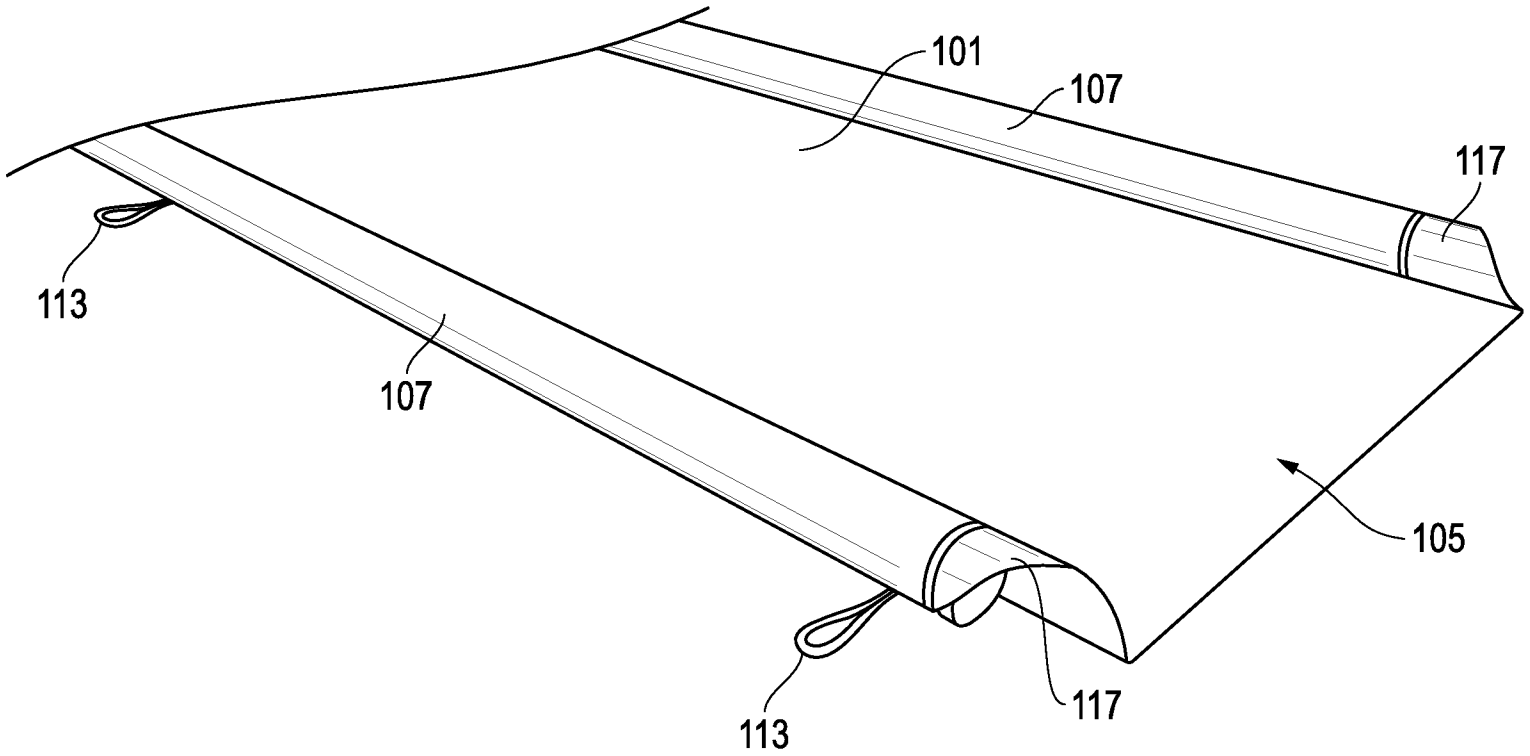
FIG. 6 is a top left isometric view of one embodiment of the flexible water slide of the present invention.

As previously discussed, it may be desirable to connect two or more slides together and, in such cases, it's important that the sliding sheets 101 ands the side tubes 107 form a seamless transition, not only to allow riders to smoothly pass from one sliding sheet 101 to the next, but also to keep water from exiting the side of the sliding sheet 101 at the seam between the tubes 107, and discouraging any opportunity for a users to catch a finger or other body part between the tubes 107. To facilitate the interconnection between slides, certain embodiments of the slide include an integrated connecting flap 117 as shown in FIG. 6 located at the exit end 105 of the slide. Because the connecting flap 117 is integrated into the tube 107, the connecting flap 117 cannot be lost and does not appear out of place when a slide is not interconnected with another slide. The spiral design of the connecting flap 117 provides a convenient, simple, safe, and secure interlocking connection between two tubes 107.

Figure 7:
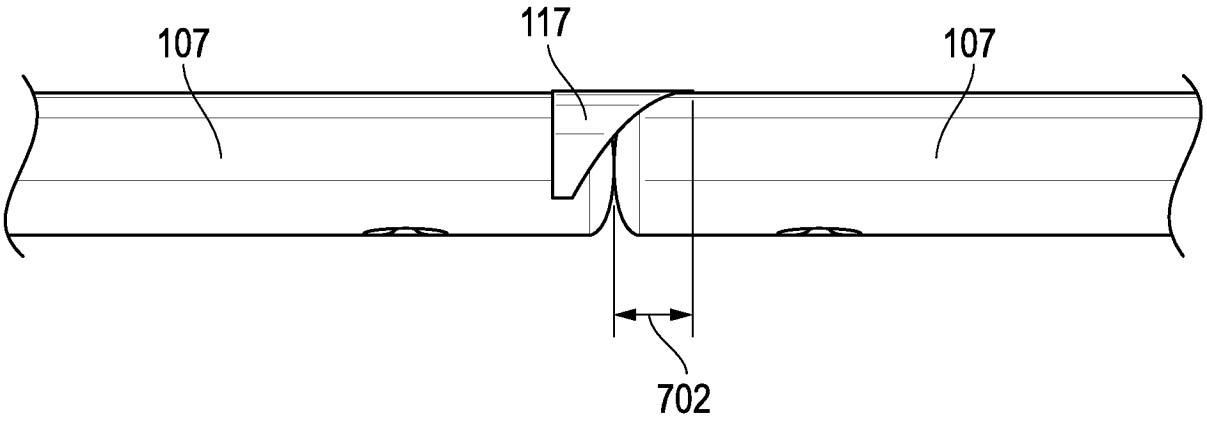
FIG. 7 is a side view of one embodiment of the connecting flap of the present invention.
Figure 8A:
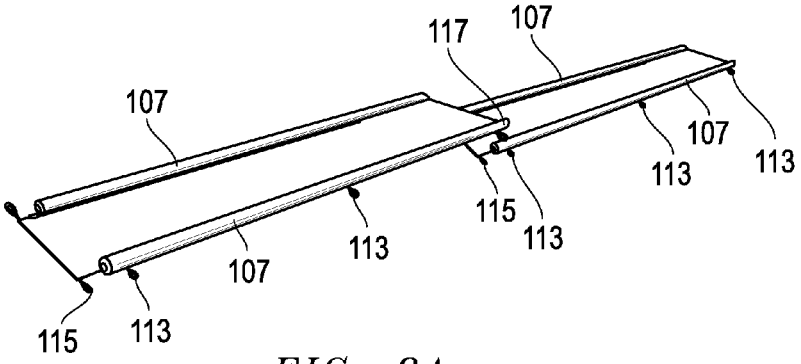
FIGS. 8A, 8B and 8C are views of one embodiment in which two sections of the flexible water slide of the present invention are interconnected with the connecting flaps.
Figure 8B:
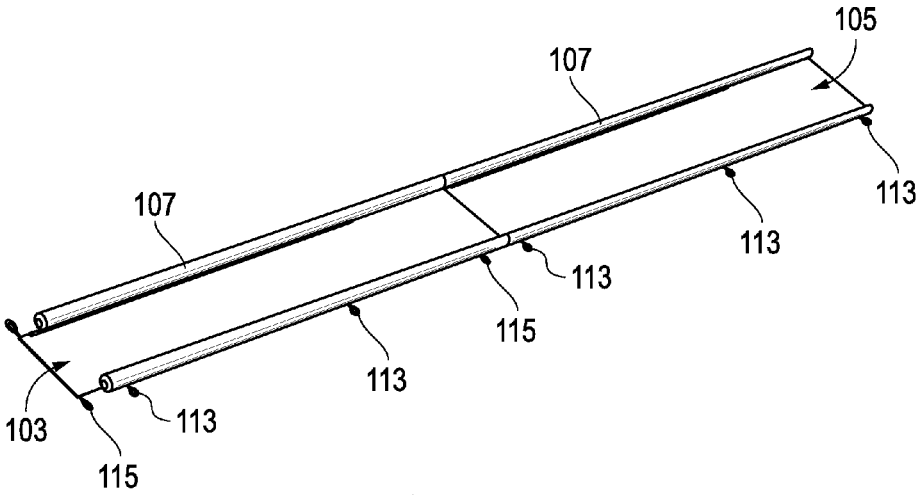
Figure 8C:
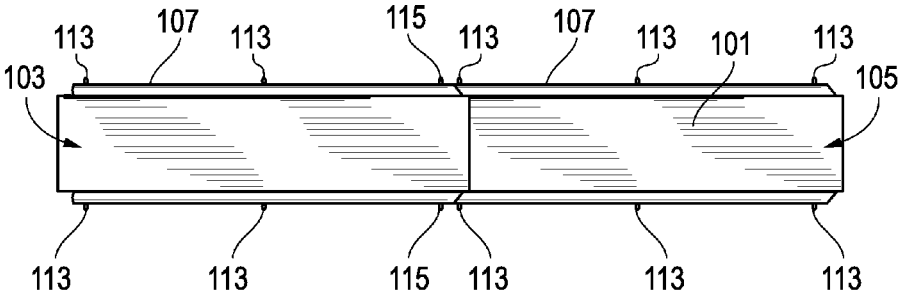

As shown in FIG. 7 and FIGS. 8A and 8B, the entry end 103 of the tube 107 slides into and is sheathed by the connecting flap 117. The connecting flap 117 may be secured by a hook and loop or other type of fastener to the entry end 103 of the adjacent tube 107. There are a number of spiral configurations of the connecting flap 117 that may be utilized in various embodiments of the present invention depending on, among other things, the diameter of the tube 107 and the length of the tongue 111, or amount of overlap, desired between the two slides. In some embodiments, the overlap 702 of the connecting flap 117 on the exit end 105 of the slide may be approximately 5.6 cm from the end of the tube 701 or may be approximately 11.5 cm from the end of the tube 701, although other configurations may be utilized and desirable.

Figure 9:
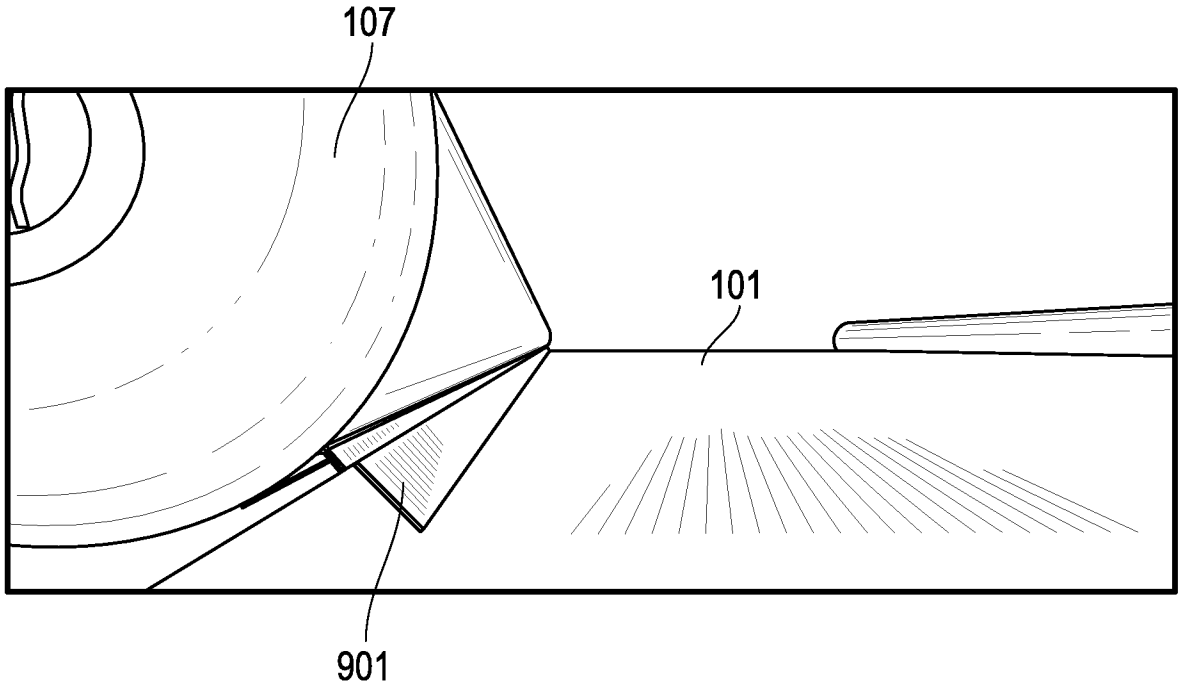
FIG. 9 is a bottom view showing the interconnection between the side arm tubes and the sliding sheet utilizing a T support.
Figure 10:
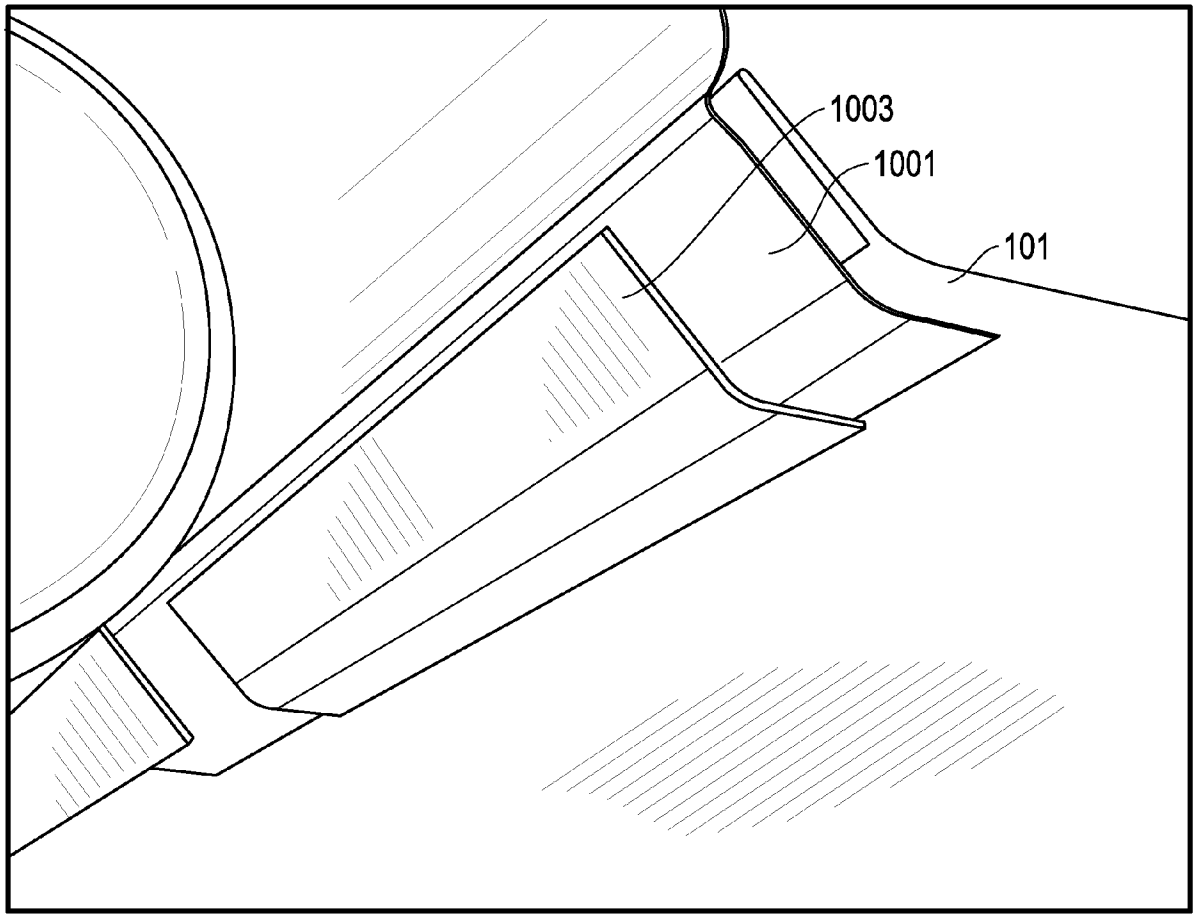
FIG. 10 is a bottom view showing the interconnection between the side arm tubes and the sliding sheet utilizing a reinforced flap.
Figure 11:
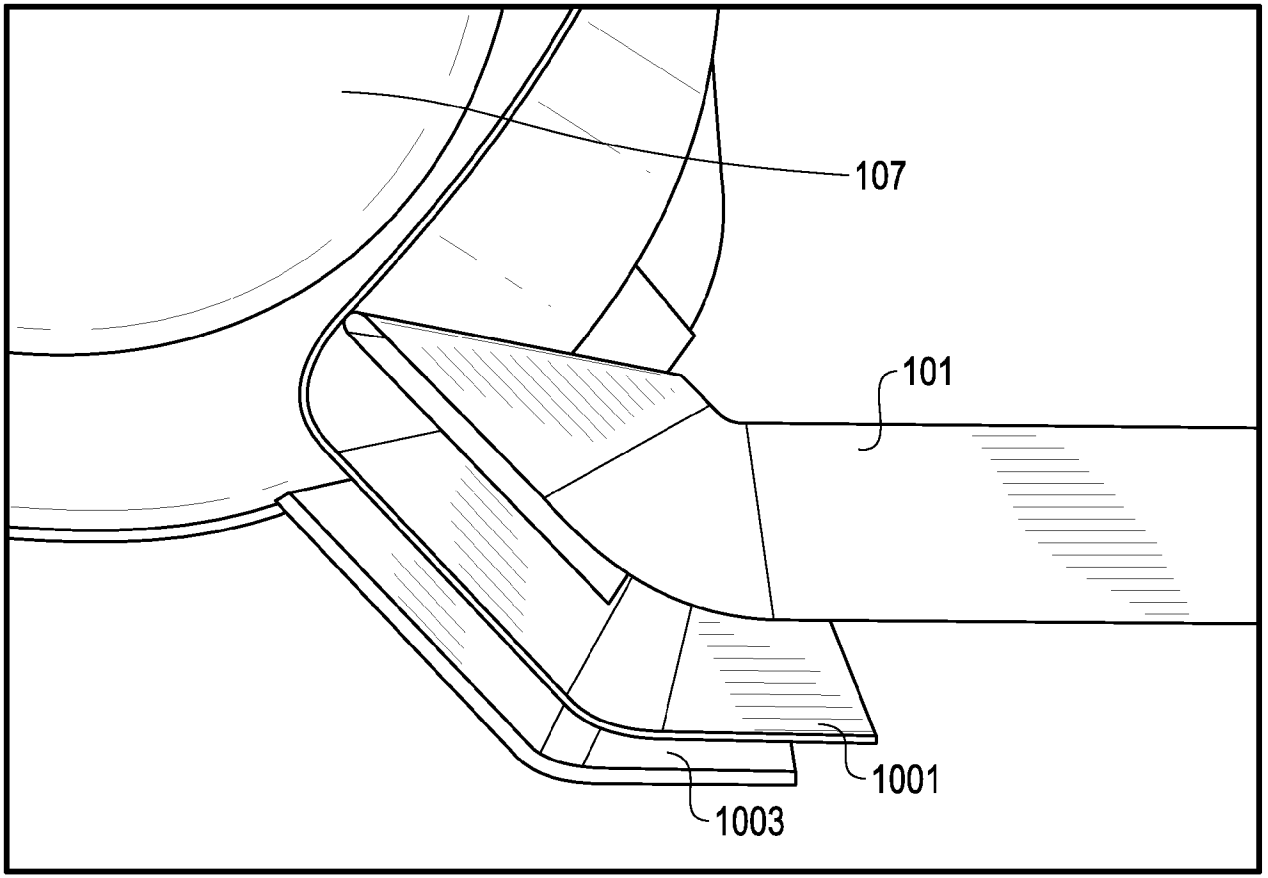
FIG. 11 is a side view showing the interconnection between the side arm tubes and the sliding sheet utilizing a reinforced flap.
Figure 12:
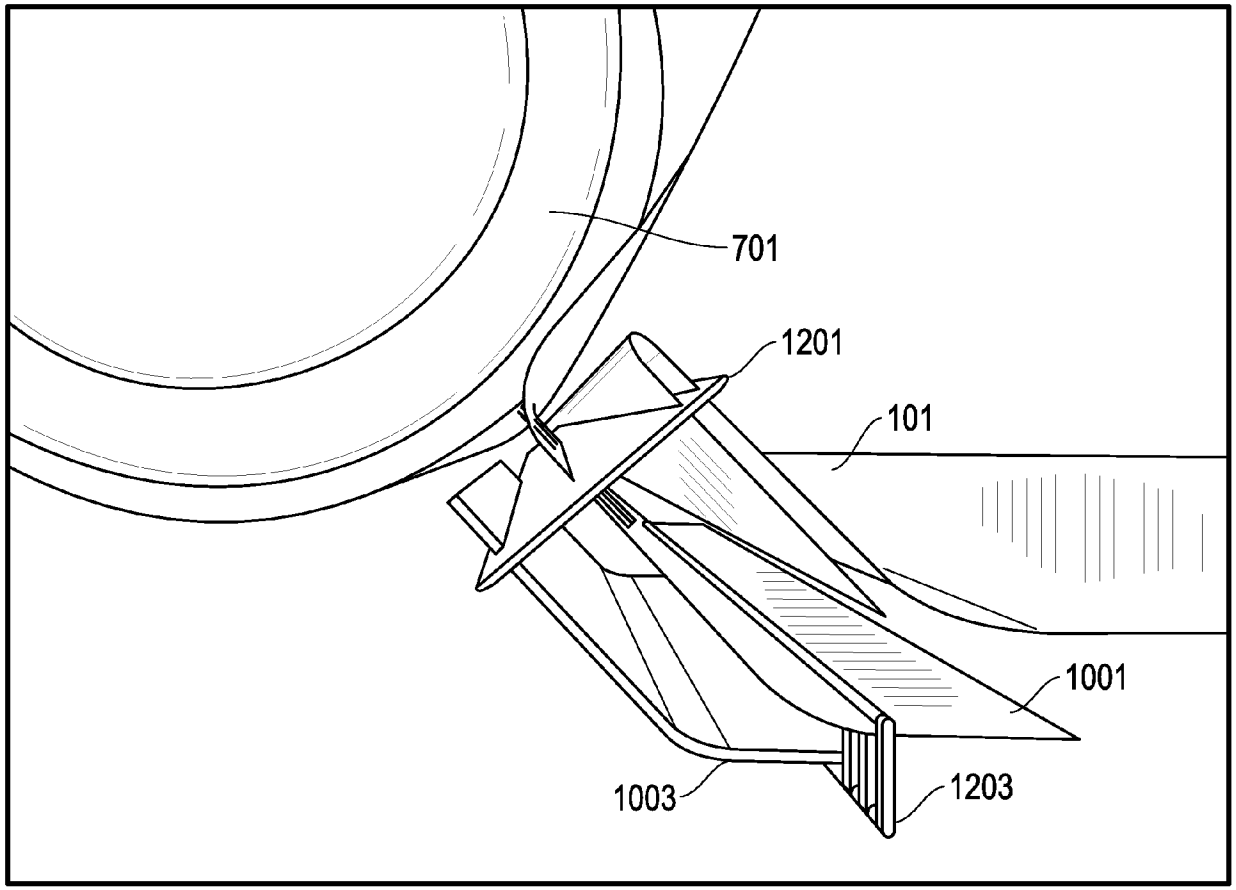
FIG. 12 is a side view showing the interconnection between the side arm tubes and the sliding sheet utilizing a reinforced flap and proposed connection sites.

Another novel aspect of the slide of the present invention is the integrated water sprayer 109. In some embodiments, the sliding sheet 101 is attached to the tube 107. The attachment may take the form of a T-seam 901 as shown in FIG. 9, or may be some other method of affixing, either removably or permanently, the sliding sheet 101 to the tube 107. In other instances, the connection may be configured as shown in FIG. 10, FIG. 11 and FIG. 12, wherein a "dog-ear" flap 1001 is attached to, and extends downwardly from, the tube 107. Sliding sheet 101 is attached to flap 1001 and to supporting structure 1005, creating an interlaced sandwich which provides a solid interconnection between the sliding sheet 101 and the tube 107. In certain embodiments, as shown in FIG. 12, the three fabrics are attached 1201 near the top of the seam while only the flap 1001 and the supporting structure 1105 are attached 1203 near the bottom of the seam. The attachment may be by any means known in the art, including sewing or stitching the layers together as described above.

Figure 13A:
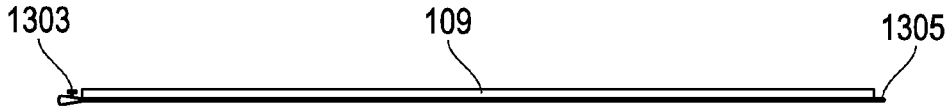
FIGS. 13A and 13B are side views of one embodiment of the integrated water sprayer of the present invention showing the interconnecting ends.
Figure 13B:
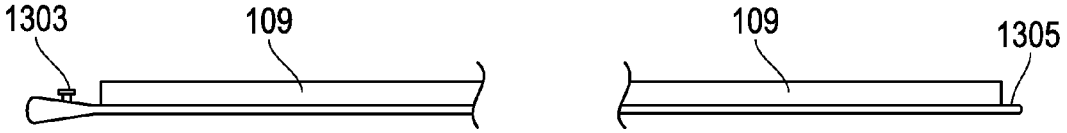

A water sprayer 109 is configured as shown in FIGS. 13A and 13B, with a perforated, linear tube having a male end 1303 and an interlocking female end 1305. The water sprayer 109 may be made, for example, of 0.5 mm PVC or other suitable material and may have, for example, eight 0.2 mm perforations therethrough. In some embodiments, it may be desirable to space the perforations evenly, starting 0.35 cm from the entry end 103 of the water sprayer 109. In some embodiments, the entry end 103 of the water sprayer 109 is configured with a female water hose connection 1303. The exit end 105 of the water sprayer 109 may also be configured with a male water hose connection 1305 so that, when two slides are interconnected, the female water hose connection 1303 connects to the male water hose connection 1305.

Figure 14A:
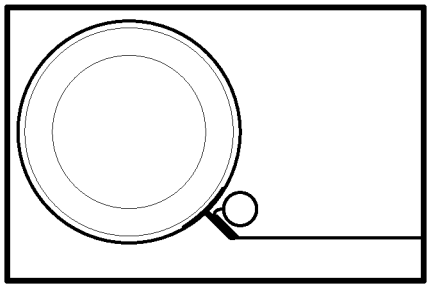
FIGS. 14A and 14B are a front view showing the interconnection between the side arm tubes and the flexible mat showing one embodiment of the location at which the integrated water sprayer is attached.
Figure 14B:
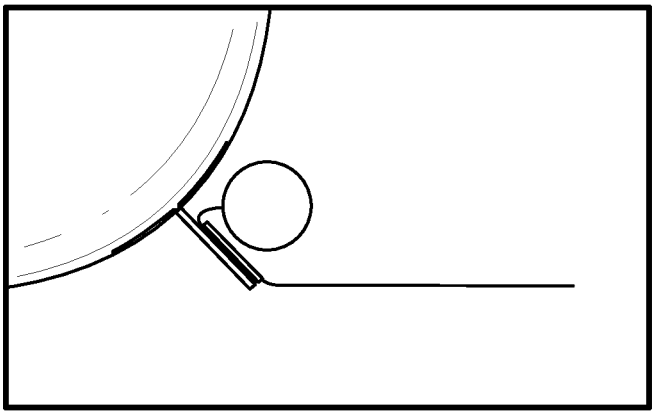

The water sprayer 109 is attached along the length of the tube 107 with the spray emanating from the water sprayer 109 directed towards the sliding sheet 101. As shown in FIGS. 14A and 14B, the water sprayer 109 may be attached to the slide by a hook and loop fastener that is sewn into the interconnection between the tube 107 and the slide sheet 101. The water sprayer 109 may be replaced in the field if necessary and may be located on either one or both sides of the sliding sheet 101.

The foregoing has outlined rather broadly certain aspects of the present invention in order that the detailed description of the invention that follows may better be understood. Additional features and advantages of the invention will be described hereinafter which form the subject of the claims of the invention. It should be appreciated by those skilled in the art that the conception and specific embodiment disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

While the present system and method has been disclosed according to the preferred embodiment of the invention, those of ordinary skill in the art will understand that other embodiments have also been enabled. Even though the foregoing discussion has focused on particular embodiments, it is understood that other configurations are contemplated. In particular, even though the expressions "in one embodiment" or "in another embodiment" are used herein, these phrases are meant to generally reference embodiment possibilities and are not intended to limit the invention to those particular embodiment configurations. These terms may reference the same or different embodiments, and unless indicated otherwise, are combinable into aggregate embodiments. The terms "a", "an" and "the" mean "one or more" unless expressly specified otherwise. The term "connected" means "communicatively connected" unless otherwise defined.

When a single embodiment is described herein, it will be readily apparent that more than one embodiment may be used in place of a single embodiment. Similarly, where more than one embodiment is described herein, it will be readily apparent that a single embodiment may be substituted for that one device.

In light of the wide variety of methods for construction of a flexible water slide known in the art, the detailed embodiments are intended to be illustrative only and should not be taken as limiting the scope of the invention. Rather, what is claimed as the invention is all such modifications as may come within the spirit and scope of the following claims and equivalents thereto.

None of the description in this specification should be read as implying that any particular element, step or function is an essential element which must be included in the claim scope. The scope of the patented subject matter is defined only by the allowed claims and their equivalents. Unless explicitly recited, other aspects of the present invention as described in this specification do not limit the scope of the claims.

What is claimed is:

1. A water slide comprising:

an elongated sliding surface;

inflatable tubes positioned along each longitudinal edge of the sliding surface;

one or more water sprayers removably positioned along an interconnection between the sliding surface and one or both of the inflatable tubes to provide a continuous water supply to the sliding surface; wherein the slide has an entry end and an exit end, and a connecting flap is affixed to the exit end of the inflatable tube and configured so that the entry end of an inflatable tube of an adjoining slide is covered and secured in place by the connecting flap.

2. The water slide of claim 1, wherein the slide has an entry end and an exit end, and the water sprayers are configured so that the exit end of one water sprayer is interconnectable with the entry end of an adjoining water sprayer to make a water-tight connection between water sprayers when interconnected.

3. The water slide of claim 1, wherein the slide has an entry end and an exit end, and the exit end of one water sprayer has a male garden hose connection and the entry end of an adjoining water sprayer has a female garden hose connection so as to form a water-tight connection between adjoining water sprayers.

4. The water slide of claim 1, wherein the sliding sheet is made of PVC.

5. The water slide of claim 1, wherein the slide has an entry end and an exit end, and wherein the exit end of the sliding sheet is configured with a tongue that may be removably secured to the entry end of an adjoining sliding sheet.

6. The water slide of claim 1, wherein the inflatable tubes are removably attached to the sliding sheet.

7. The water slide of claim 1, wherein the connection between the tubes and the sliding sheet prevents water from exiting the lateral edges of the sliding sheet.

8. The water slide of claim 1, wherein the tubes are configured with end caps which seal the tubes after they have been inflated.

9. The water slide of claim 1, wherein the tubes are configured with end caps which seal the tubes after they have been inflated, and each of the end cap is configured with an inflation valve.

* * * * *